US007717301B2

(12) United States Patent
Tsai

(10) Patent No.: US 7,717,301 B2
(45) Date of Patent: May 18, 2010

(54) PISTON DEVICE AND A FLUID/GAS DRAWING APPARATUS AND A FOAM PRODUCING APPARATUS USING SUCH PISTON DEVICE

(75) Inventor: A-Feng Tsai, Hsinchu (TW)

(73) Assignee: Yih Tai Glass Industrial Co., Ltd., Hsinchu (TW)

( * ) Notice: Subject to any disclaimer, the term of this patent is extended or adjusted under 35 U.S.C. 154(b) by 1052 days.

(21) Appl. No.: 11/414,336

(22) Filed: May 1, 2006

(65) Prior Publication Data

US 2007/0119864 A1 May 31, 2007

(30) Foreign Application Priority Data

Nov. 25, 2005 (TW) ..... 94220454 U

(51) Int. Cl.
*B67D 7/76* (2010.01)
*B65D 88/54* (2006.01)

(52) U.S. Cl. ..... 222/190; 222/321.2

(58) Field of Classification Search ..... 222/145.5, 222/190, 321.2, 145.6, 321.7, 383.1
See application file for complete search history.

(56) References Cited

U.S. PATENT DOCUMENTS 6,206,303 B1 * 3/2001 Shinozaki et al. ..... 239/333
6,446,840 B2 * 9/2002 Ophardt et al. ..... 222/190
6,612,468 B2 * 9/2003 Pritchett et al. ..... 222/190
6,923,346 B2 * 8/2005 Foster et al. ..... 222/190

FOREIGN PATENT DOCUMENTS

TW 088205688 4/1999
TW 094202158 2/2005

* cited by examiner

*Primary Examiner*—Kevin P Shaver
*Assistant Examiner*—Melvin A Cartagena
(74) *Attorney, Agent, or Firm*—WPAT, PC; Justin King

(57) ABSTRACT

A piston device comprises a sleeve, a casing pipe, a first piston, a resilient member, and a second piston. The sleeve includes at least one hole arranged at the periphery of its closed end. The casing pipe has at least a through hole arranged on a lateral side thereof proximate to its closed end and is sheathed and connected to the sleeve by a manner that the open end of the casing pipe is faced toward the closed end of the sleeve. The first piston is arranged to sheathe the casing pipe at a position proximate to the closed end of the casing pipe for selectively covering and exposing the through hole by a reciprocate movement. The resilient member is installed in side the sleeve at a position between the closed end of the sleeve and the first piston while ensheathing the casing pipe therethrough. The second piston is arranged to sheathe the sleeve at a position proximate to its open end. Moreover, by combining the piston device with a container containing fluid and gas, a fluid/gas drawing apparatus can be formed, and, by combining the fluid/gas drawing apparatus with a nozzle, a foam producing apparatus capable of producing thick foams can be formed.

19 Claims, 8 Drawing Sheets

PISTON DEVICE AND A FLUID/GAS DRAWING APPARATUS AND A FOAM PRODUCING APPARATUS USING SUCH PISTON DEVICE

FIELD OF THE INVENTION

The present invention relates to a piston device, and more particularly, to a piston device capable of having two pistons separately installed in two pipes of different diameters that contain fluids for providing alternate back-and-forth movements to draw gases and liquids and a nozzle for mixing the fluids is combined with the piston device to produce foams, and the invention also relates to a fluid drawing apparatus and a foam producing apparatus that use such piston device.

BACKGROUND OF THE INVENTION

As the standard of our life advances, the methods of using daily commodities such as beauty treatment kits, and personal sanitary and bath products indispensable to our life are improved according to the advancement of related technologies. For example, shampoo has evolved from shampoo powder to bottled liquid shampoo, and users just need to gently press the bottle to draw liquid shampoo. The major core of these products resides on the apparatus of drawing liquid shampoo or hair gel. This type of pump drawing apparatus simply requires users to press a pull handle or a press handle to draw the liquid from a can or a bottle and obtain the desired result (such as sprays, foams, or liquid discharges).

Referring to FIG. 1 for the schematic view of a drawing structure of a prior art sprayer, the drawing structure 1 includes a casing pipe 12 coupled to the bottom of a nozzle 11, and the casing pipe 12 includes a drawing pipe 13, and the bottom of the drawing pipe 13 is coupled to a conical cover 14. The bottom of the conical cover 14 allows a pressing rod 15 to pass through, and the rear end of the pressing rod 15 presses against an end of a spring 16, and another end of the spring 16 has a ball 17, and a containing pipe 18 accommodates the drawing pipe 13, conical cover 14, pressing rod 15, spring 16, and ball 17 vertically and sequentially in the pipe, and the bottom of the containing pipe 18 includes a sucking pipe 19, and the whole drawing structure 1 is placed in a liquid can or bottle for drawing liquids.

The related drawing apparatuses for drawing liquid from a bottle have been disclosed in R.O.C. Pat. Application Nos. 094202158 and 088205688. The drawing apparatuses as disclosed in forgoing patented technology can only draw a liquid, but cannot simultaneously draw a liquid and a gas. In certain occasions that require the use of foams such as disk washing or hair shampooing, the foregoing drawing apparatuses are generally used for drawing detergent or shampoo, and users produce foams by rubbing the detergent or shampoo with hands. However, such arrangement usually cannot control the consuming quantity of detergent or shampoo. Particularly, excessive detergent may remain on kitchenware, if the kitchenware is not rinsed thoroughly, and finally may hurt human bodies. The same situation applies to shampoo, and the shampoo remained on our scalp may cause damages to our scalp.

In summation to the description above, a piston device and a fluid drawing apparatus and a foam producing apparatus using such piston device are required to provide the functions of drawing a liquid and a gas as well as appropriately producing foams easily, so as to overcome the shortcomings of the prior art.

SUMMARY OF THE INVENTION

The primary objective of the present invention is to provide a piston device and a fluid drawing apparatus and a foam producing apparatus using such piston device, and the piston device comprises two pistons installed in two pipes having different diameters and containing fluids for alternate back-and-forth movements, so as to achieve the effect of discharging gases and liquids from the pipe.

The secondary objective of the present invention is to provide a piston device and a fluid drawing apparatus and a foam producing apparatus using such piston device, and the resilience of a resilient member drives two pistons to move back and forth in the pipes of different diameters, such that vacuum suctions can be produced during the return path of the pistons to achieve the effects of drawing a liquid from a can and drawing an external air.

Another objective of the present invention is to provide a piston device and a fluid drawing apparatus and a foam producing apparatus using such piston device, and the piston device comprises two pistons installed in two pipes of different diameters and containing fluids for alternate back-and-forth movements to discharge gases and liquids, and the fluids pass through a nozzle for mixing the fluids to achieve the effect of producing foams.

To achieve the foregoing objectives, a piston device of the invention comprises: a sleeve, having at least one hole disposed around the periphery of a closed end thereof; a casing pipe, having at least one through hole arranged on a lateral side thereof proximate to its closed end and being sheathed and connected to the sleeve by a manner that the open end of the casing pipe is faced toward the closed end of the sleeve; a first piston, being arranged to ensheathe the casing pipe therethrough at a position proximate to the closed end of the casing pipe for selectively covering and exposing the through hole by a reciprocate movement; a resilient member, being installed in side the sleeve at a position between the closed end of the sleeve and the first piston while ensheathing the casing pipe therethrough; and a second piston, being arranged to ensheathe the sleeve at a position proximate to the open end of the sleeve.

Preferably, a closed end of the sleeve is coupled to a hollow piping, and an open end of the hollow piping is interconnected to a closed end of the sleeve, and another open end of the hollow piping is disposed inside the sleeve. The hollow piping further comprises a groove disposed at an open side of the sleeve for accommodating an open end of the casing pipe. One end of the resilient member presses against a pipe-opening wall of the hollow piping while the other end presses against the first piston.

Preferably, the hollow piping is coupled to an end of the casing pipe and the external wall of the casing pipe has screw threads mutually engaged to the hollow piping.

Preferably, the sidewall of the sleeve further includes a first circular blocking member, and the open end of the sleeve includes the second circular blocking member such that the second piston can move back and forth between the first circular blocking member and the second circular blocking member, wherein the second piston includes a plurality of protruding ribs disposed on a wall surface corresponding to the sidewall of the sleeve for forming a plurality of partition spaces between the second piston and the sleeve.

To achieve the foregoing objectives, a fluid drawing apparatus of the present invention comprises: a sleeve, having at least one hole disposed around the periphery of a closed end thereof; a casing pipe, having at least one through hole arranged on a lateral side thereof proximate to its closed end and being sheathed and connected to the sleeve by a manner that the open end of the casing pipe is faced toward the closed end of the sleeve; a first piston, being arranged to ensheathe the casing pipe therethrough at a position proximate to the closed end of the casing pipe for selectively covering and exposing the through hole by a reciprocate movement; a resilient member, being installed in side the sleeve at a position between the closed end of the sleeve and the first piston while ensheathing the casing pipe therethrough; a second piston, being sheathed along a sidewall proximate to the open end of the sleeve; a casing, including a first space and a second space, and the first space maintaining airtight with the first piston while the second space maintaining airtight with the second piston; and a second resilient member, installed in the casing wherein one end of the second resilient member presses against the second piston while the other end of the second resilient member presses against the bottom of the casing.

Preferably, the casing further comprises an external pipe for accommodating the second piston, and the internal wall of the external pipe maintains airtight with the second piston, and an internal pipe is installed in the external pipe, and an open end of the internal pipe is interconnected to a closed end of the external pipe, and the internal wall of the internal pipe maintains airtight with the first piston, and the diameter of the internal pipe is smaller than the diameter of the sleeve. An area between the external pipe and the internal pipe is the second space, and a space inside the internal pipe is the first space. The internal pipe further includes a check valve disposed at an end interconnected to the external pipe.

Preferably, the second resilient member is sheathed onto the internal pipe.

Preferably, the check valve further comprises: at least one blocking member disposed on the internal wall of the internal pipe; a hollow flared member installed onto the internal pipe interconnected to an end of the external pipe; and a sphere disposed between the blocking member and the hollow flared member, and the diameter of the sphere falls in the range of the maximum and minimum diameters of the hollow flared member. The flared member is further coupled to a sucking pipe.

To achieve the foregoing objective, a foam producing apparatus of the present invention comprises: a sleeve, having at least one hole disposed around the periphery of a closed end thereof; a casing pipe, having at least one through hole arranged on a lateral side thereof proximate to its closed end and being sheathed and connected to the sleeve by a manner that the open end of the casing pipe is faced toward the closed end of the sleeve; a first piston, being arranged to ensheathe the casing pipe therethrough at a position proximate to the closed end of the casing pipe for selectively covering and exposing the through hole by a reciprocate movement; a resilient member, being installed in side the sleeve at a position between the closed end of the sleeve and the first piston while ensheathing the casing pipe therethrough; a second piston, being sheathed along a sidewall proximate to the open end of the sleeve; a casing, including a first space and a second space, and the first space maintaining airtight with the first piston while the second space maintaining airtight with the second piston; a second resilient member, installed in the casing wherein one end of the second resilient member presses against the second piston while the other end of the second resilient member presses against the bottom of the casing; and a fluid/gas mixing nozzle, coupled and interconnected to the sleeve.

Preferably, the fluid/gas mixing nozzle further comprises: a nozzle having an accommodating space; and a valve installed in the accommodating space, and a side of the valve having a fluid mixing space interconnected to the casing pipe and another side having a valve plate proximate to the hole, and a valve having a circular post proximate to the surface of the valve plate, and a wall surface of the circular post having an air hole interconnected to the fluid mixing space, wherein a first net member is installed between the circular post and the fluid mixing space, and a second net member is installed between the nozzle and the fluid mixing space.

DESCRIPTION OF THE PREFERRED EMBODIMENT

Figure 1:
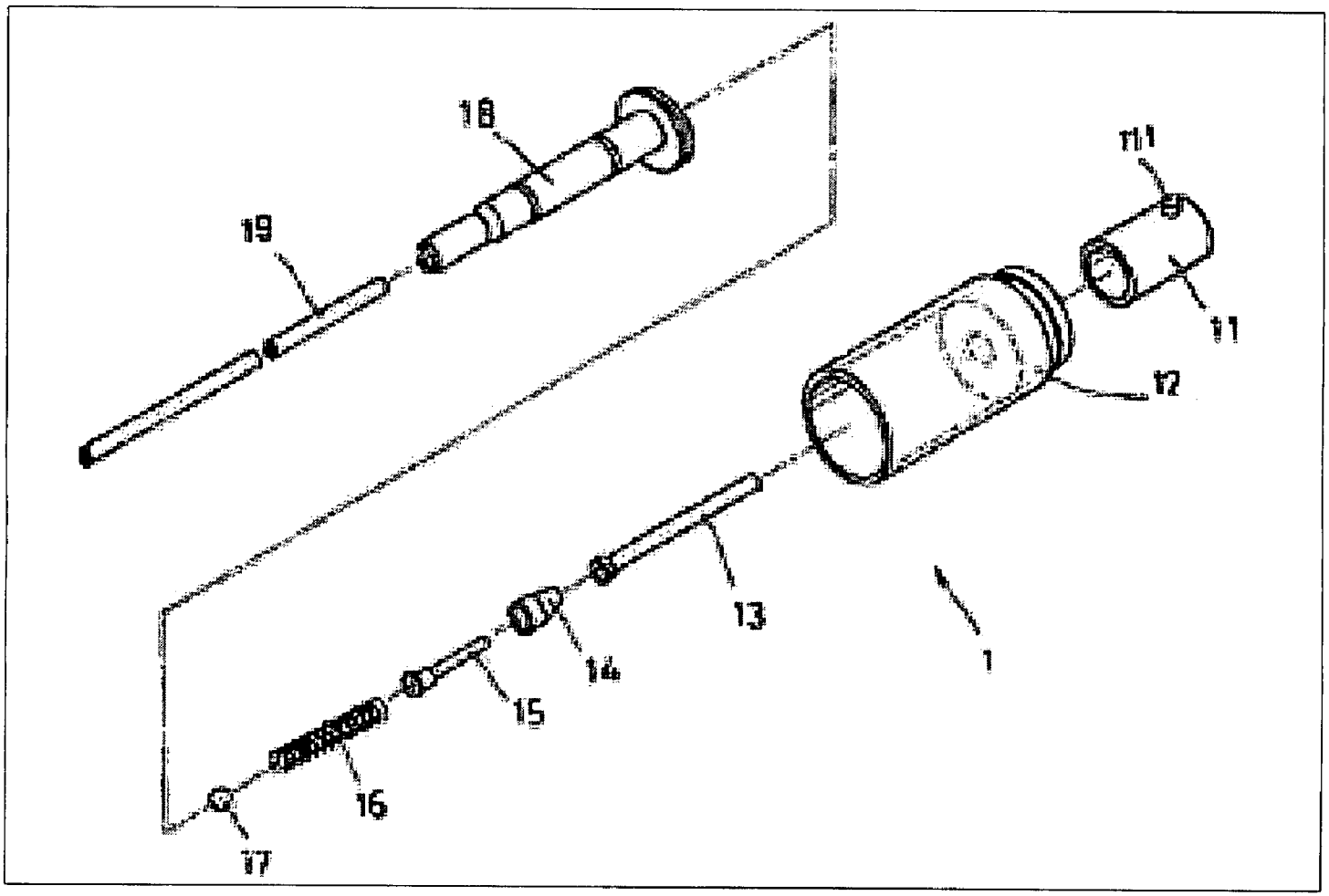
FIG. 1 (PRIOR ART)
FIG. 1 is a schematic view of a prior art fluid drawing apparatus.

To make it easier for our examiner to understand the objective of the invention, its structure, innovative features, and performance, we use a preferred embodiment together with the attached drawings for the detailed description of the invention. Only some embodiments of the present invention have been illustrated in the drawings, but it should be pointed out that many other modifications are conceivable within the scope of the following claims.

Figure 2A:
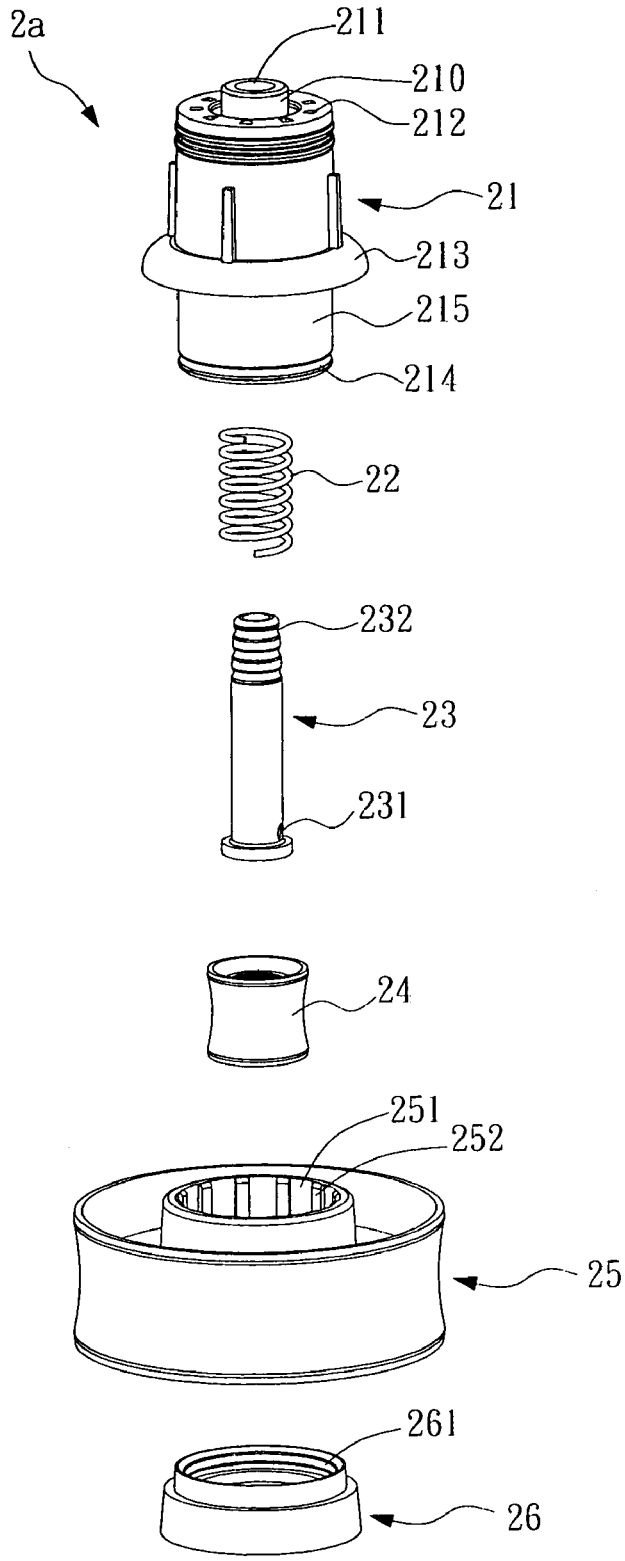
FIG. 2A is an exploded view of a piston device according to a preferred embodiment of the present invention.
Figure 2B:
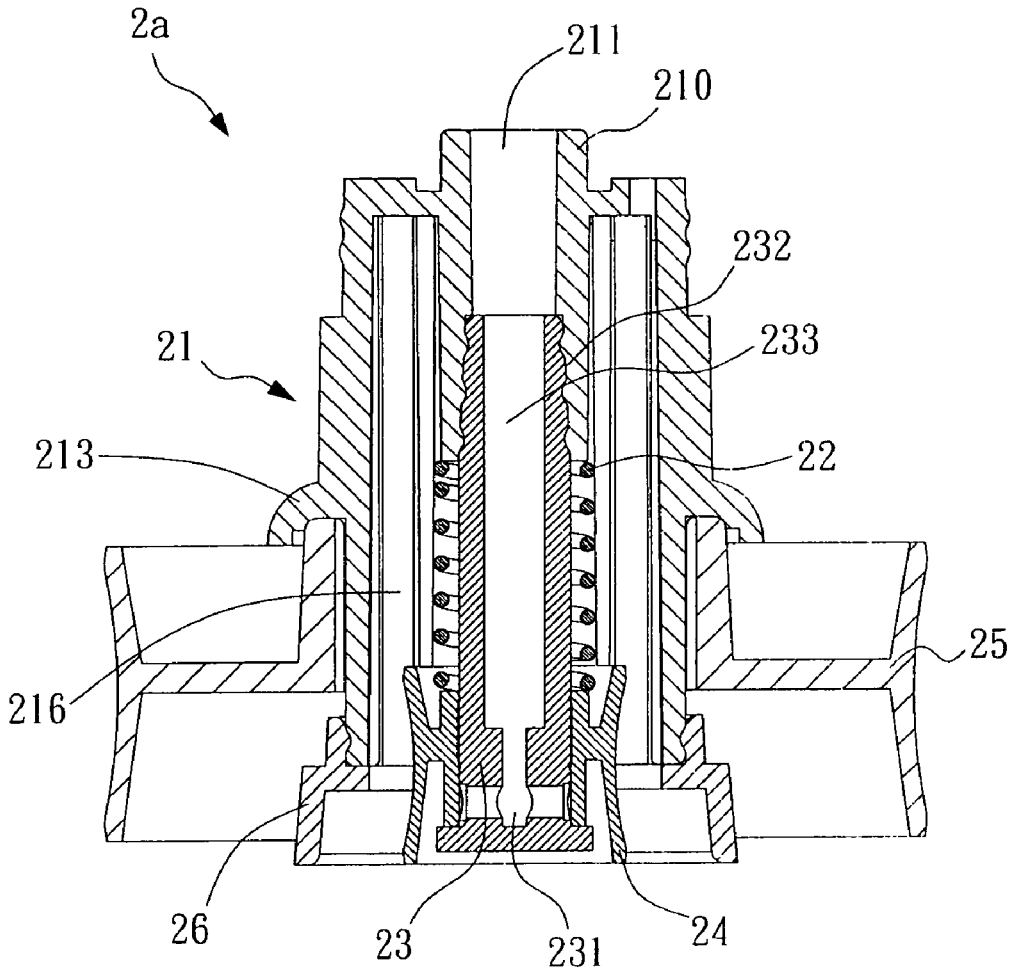
FIG. 2B is a cross-sectional view of a piston device according to a preferred embodiment of the present invention.

Referring to FIGS. 2A and 2B for the exploded view and the cross-sectional view of a piston device according to a preferred embodiment of the present invention respectively. The piston device 2*a* comprises a sleeve 21, a casing pipe 23, a first resilient member 22, a first piston 24, and a second piston 25. The sleeve 21 is a hollow cylindrical body, wherein one side of the sleeve 21 is an opening, and the other side is a closed surface. The rim of the closed surface includes a plurality of holes 212 interconnected to the hollow area inside the sleeve 21. The quantity of holes 212 depends on actual needs and basically there just at least one hole is enough for requirement. In this preferred embodiment, the number of holes 212 is more than one. In FIG. 2B, the central area of the closed surface of the sleeve 21 has a hollow piping 210, and one opening of the channel 211 of the hollow piping 210 protrudes from the closed surface of the sleeve 21, while the other opening of the channel 211 at the end of the hollow piping 210 is disposed inside the hollow area of the sleeve 21. The opening of hollow piping 210 inside the sleeve 21 has a groove, and the sidewall of the groove has a screw thread for the fixing purpose.

The casing pipe 23 is a hollow pipe, and one side of the casing pipe 23 is a closed surface, while the other side is an open surface. The casing pipe 23, passing through the first piston 24 and the first resilient member 22, connects with the hollow piping 210. A portion of the external wall of the casing pipe 23 proximate to the open end has a screw thread 232 that can be engaged with the screw thread on the internal wall of the groove of the hollow piping 210, so that the casing pipe 23 can be fixed in the hollow piping 210. The hollow channel inside the casing pipe 23 and the hollow piping 210 both constitute a channel 233 for fluid running. As to the ways for fixing the casing pipe 23 and the hollow piping 210, there are many different ways to achieve, and it should not be limited to the way disclosed in this preferred embodiment only. A lateral side of the casing pipe 23 proximate to the closed surface includes two corresponding through holes 231 (only one through hole 231 is shown in the figure), and the through hole 231 is interconnected to the channel 233 inside the casing pipe 23.

An end of the first resilient member 22 presses against the external wall of the opening of the hollow piping 210 while the other end presses against the first piston 24. When the first resilient member 22 is in its initial state, the first piston 24 will cover the through hole 231 so as to prevent the through hole 231 from communicating with the external area. If an external force is applied to the first piston 24 to compress the first resilient member 22, then the through hole 231 will be exposed so that fluid in the external area can flow to the channel 233 through the through hole 231. Therefore, the external force and a restoring force of the first resilient member 22 can reciprocate the first piston 24 along the casing pipe 23 for selectively covering and exposing the through hole 231.

A hollow area of the second piston 25 ensheathes the sidewall 215 of the sleeve 21, and, as shown in FIG. 2A, the hollow area of the second piston 25 includes a plurality of protruding ribs 252 disposed on a wall surface corresponding to the sidewall 215 of the sleeve 21 for forming a plurality of partition spaces 251 between the hollow area of the second piston 25 and the sidewall 215 of the sleeve. To allow and restrict the second piston 25 to slide along the sidewall 215 of the sleeve 21, the sidewall 215 of the sleeve 21 further comprises a first circular blocking member 213; meanwhile, the opening of sleeve 21 uses a latch member 214 to latch a latch member 261 of the second circular blocking member 26, so that the second piston 25 can be constrained to slide between the first and second circular blocking member 213, 26.

The first circular blocking member 213 comes with an arc-shape design. If the first circular blocking member 213 contacts against the second piston 25, the partition space 251 will be airtight completely at the side which the second piston 25 contact with the first circular blocking member 213. One purpose of the second circular blocking member 26 is to prevent the second piston 25 from being separated from the sleeve 21. Besides providing a partition space, the plurality of protruding ribs 252 also allows a one-dimensional steady sliding movement for the second piston 25 along the sleeve 21. Of course, the protruding ribs 252 adopted in this preferred embodiment are not limited to such arrangement. For example, removing the protruding ribs 252 or implementing the protruding ribs 252 by other methods, such as disposing the protruding ribs on the sidewall 215 other than the second piston 25 alternatively, are also covered in the scope of the patent claims of this invention.

Figure 3:
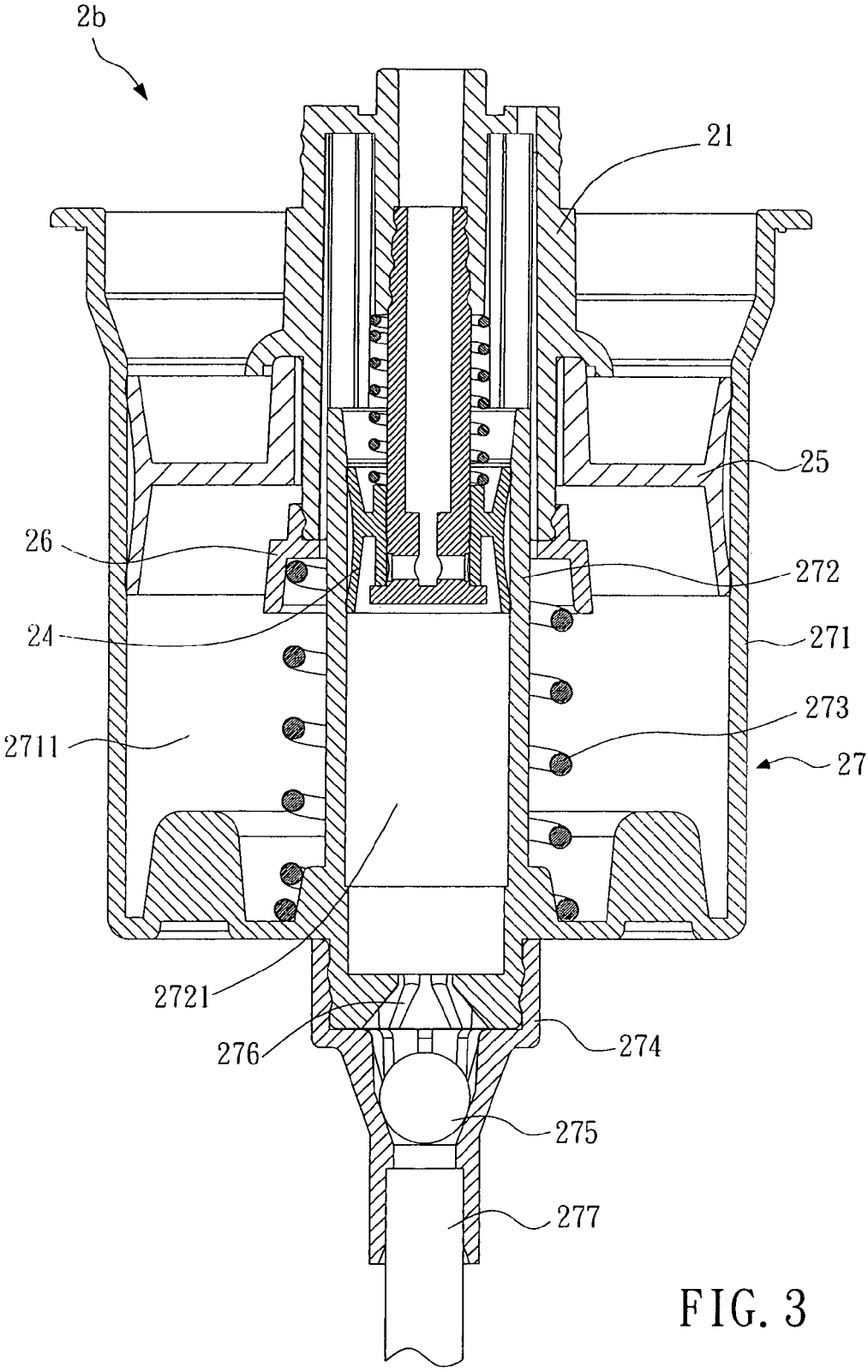
FIG. 3 is a cross-sectional view of a fluid/gas drawing apparatus according to a preferred embodiment of the present invention.

Referring to FIG. 3 for the schematic view of a fluid/gas drawing apparatus according to a preferred embodiment of the present invention, the piston device 2*a* as shown in FIG. 2A is coupled to a casing 27 to form a fluid/gas drawing apparatus 2*b* capable of drawing liquids and gases. The casing 27 includes an external pipe 271 and an internal pipe 272. The internal wall of the external pipe 271 maintains airtight with the second piston 25, so that the second piston 25 can reciprocate along the internal wall of the external pipe 271. The internal pipe 272, disposed inside the external pipe 271, interconnects to the external pipe 271 to communicate with the outside, and a second resilient member 273 is arranged around the external wall of the internal pipe 272. The internal wall of the internal pipe 272 maintains airtight with the first piston 24.

The diameter of the internal pipe 272 is smaller than the diameter of the sleeve 21, so that the second piston 25 can move back and forth along the internal wall of the external pipe 271 smoothly. One side of the second circular blocking member 26 presses against the second resilient member 273, and the second resilient member 273 provides a restoring force required for the back-and-forth movements of the second piston 25. The space between the internal wall of the external pipe 271 and the external wall of the internal pipe 272 is a gas space 2711, and the space inside the internal pipe 272 is a liquid space 2721.

The exterior at the bottom of the casing 27 further comprises a check valve, comprising a hollow flared member 274 communicates with the end of the internal pipe 272. The hollow flared member 274 contains a steel ball 275. To prevent the steel ball 275 falling out from the hollow flared member, at least one blocking member 276 is disposed at the internal wall of the internal pipe 272 proximate near to the opening of the hollow flared member for constraining the steel ball 275 in the hollow flared member 274. The diameter of the steel ball 275 falls in the range of the maximum and minimum diameters of the hollow flared member 274. The opening of the flared member 274 having maximum diameter is interconnected to the internal pipe 272, and the opening of the flared member 274 having minimum diameter is coupled to a sucking pipe 277.

Figure 4:
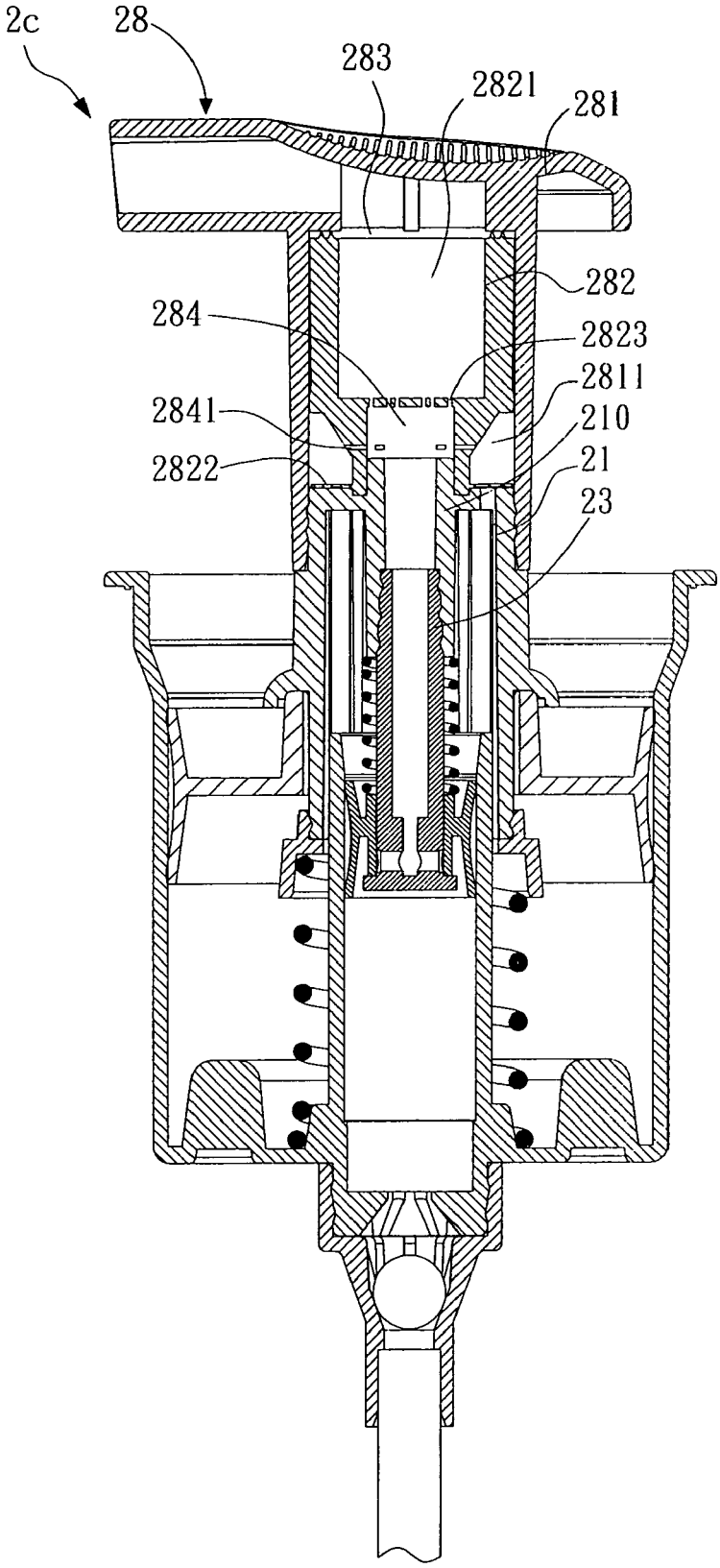
FIG. 4 is a cross-sectional view of a foam producing apparatus according to a preferred embodiment of the present invention.

Referring to FIG. 4 for the cross-sectional view of a foam producing apparatus according to a preferred embodiment of the present invention, the fluid drawing apparatus 2*b* as shown in FIG. 3 is coupled to a fluid/gas mixing nozzle 28 to form a foam producing apparatus 2*c*. The fluid/gas mixing nozzle 28 includes a nozzle 281 and a valve 282. The nozzle 281 includes an accommodating space 2811 and the nozzle 281 is connected onto the sleeve 21. The valve 282 is installed in the accommodating space 2811, and one side of the valve 282 has a fluid mixing space 2821 interconnected to the casing pipe 23 and the other side has a valve membrane 2822 adjacent to the hole 212. The valve 282 proximate to the lateral surface of the valve membrane 2822 has a circular post 284 whose lateral surface has air holes 2841 interconnected to the fluid mixing space 2821, and which is interconnected to the hollow piping 210. Therefore, a liquid passing from the internal pipe 272 through the casing pipe 23 and the hollow piping 210 to the circular post 284 and entering into the fluid mixing space 2821 can mix with a gas entering from the air hole 2841 to the fluid mixing space 2821. To achieve a better foam producing effect, a first net member 2823 is installed between the circular post 284 and the fluid mixing space 2821, and a second net member 283 is installed between the nozzle 281 and the fluid mixing space 2821.

Figure 5:
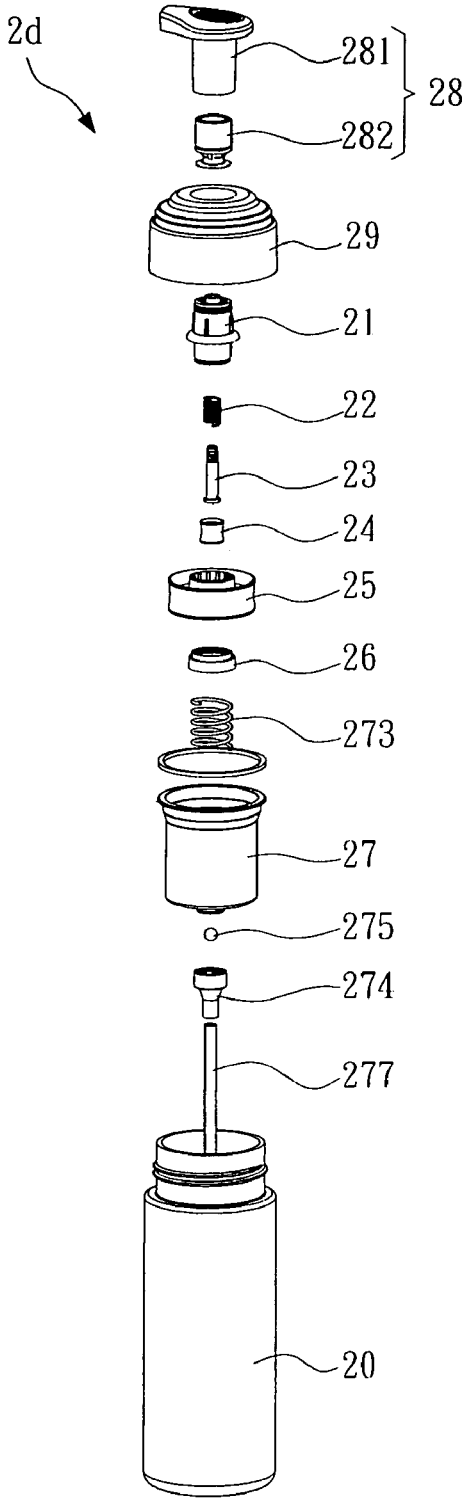
FIG. 5 is a schematic view of a foam bottle comprised of a foam producing apparatus according to a preferred embodiment of the present invention.
Figure 6A:
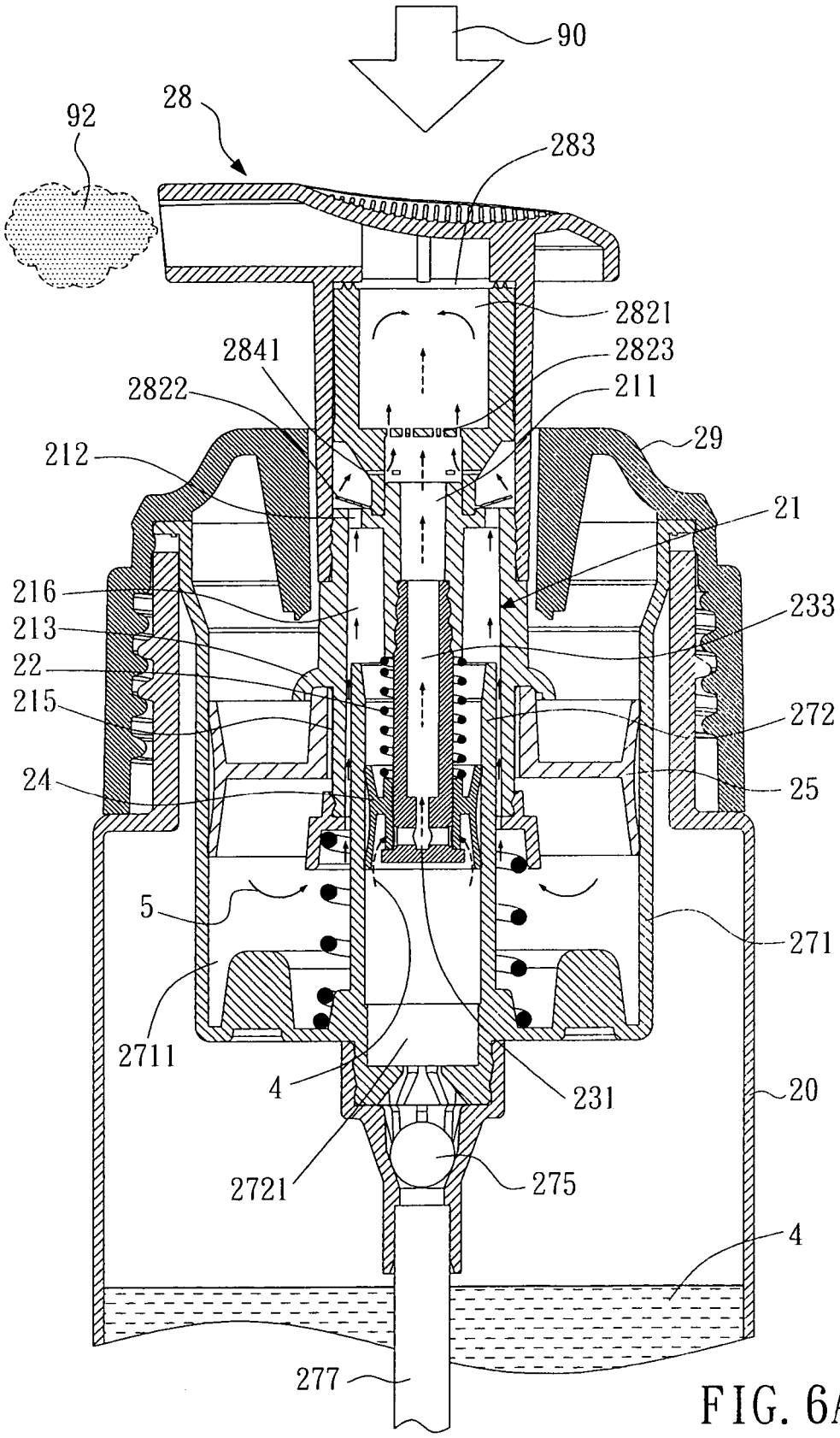
FIG. 6A is a schematic view of the movements of a foam producing apparatus being compressed to produce foams according to the present invention.

Referring to FIG. 5 for the schematic view of a foam bottle comprised of a foam producing apparatus according to a preferred embodiment of the present invention. A foam bottle 2*d* is formed by combining a can 20 with the foam producing apparatus 2*c* wherein a lid 29 is adopted to fix the foam producing apparatus 2*c* and the can 20. Referring to FIG. 6A which is the schematic view of the movements of a foam producing apparatus being compressed to produce foams according to the present invention. A user can apply a pressure 90 onto the fluid/gas mixing nozzle 28 to produce the foam. The foam producing process is expressed in the following two actions: one is drawing a gas and the other is drawing a liquid. When the user applies a pressure, the fluid/gas mixing nozzle 28 will press the sleeve 21 to move downward. As a result, the sleeve 21 will drive the second piston 25 to move downward. Since the second piston 25 keeps airtight with the internal wall of the external pipe 271, the gas in the gas space 2711 will exert an acting force onto the second piston 25 during the downward process. Since the second piston 25 is capable of sliding along the sidewall 215 of the sleeve 21, therefore the second piston 25 will slide upward and press against the first circular blocking member 213 due to the acting force generated from gas inside the gas space 2711.

Although a partition space (not shown in the figure) is disposed between the second piston 25 and the sidewall of the sleeve 21, the gas in the gas space 2711 will not leak from the partition space due to the second piston 25 contacting with the first circular blocking member 213 airtightly. Since the diameter of the sleeve 21 is larger than the diameter of the internal pipe 272, during the second piston 25 moves downward in the external pipe 271, a gap (as shown in an area indicated by a solid-line arrow), which is between the sleeve 21 and the internal pipe 272, will be produced, and the gas compressed by the second piston 25 will be pushed and discharged from the gap between the internal wall of the sleeve 21 and the external wall of the internal pipe 272. With the further continuous movement downward of the second piston 25, the pressure will push the gas from a space 216 inside the sleeve 21 through the hole 212 and pass through the valve membrane 2822, and then the gas will pass through the air hole 2841 and the first net member 2823 into the fluid mixing space 2821. In the figure, a solid-line arrow indicates the moving direction of the gas.

The way of drawing a liquid 4 will be described as follows. If a user presses the fluid/gas mixing nozzle 28, the fluid/gas mixing nozzle 28 will drive the sleeve 21 to move downward, and thus the sleeve 21 will drive the first piston 24 to move downward to push the liquid 4 in the liquid space 2721 of the internal pipe 272. Due to the existence of the steel ball 275, the liquid 4 will not flow back into the can 20; instead the liquid 4 reacts on the first piston 24. If such reacting force generated from the liquid 4 is greater than the resilience of the first resilient member 22, the first piston 24 will move upward by the pressing of the liquid 4. Once the first piston 24 moves upward, the through hole 231 is exposed so that the liquid 4 inside the liquid space 2721 is capable of flowing into the channel 233 of the casing pipe 23 via the through hole 231 and moves upward to pass through the channel 211 of the hollow piping, the first net member 2823 subsequently and, finally, into the fluid mixing space 2821. The gas 5 and the liquid 4 in the fluid mixing space 2821 are pushed by the pressure to pass the second net member 283 to produce thick foams 92 and the foams 92 are discharged from the nozzle 281.

Figure 6B:
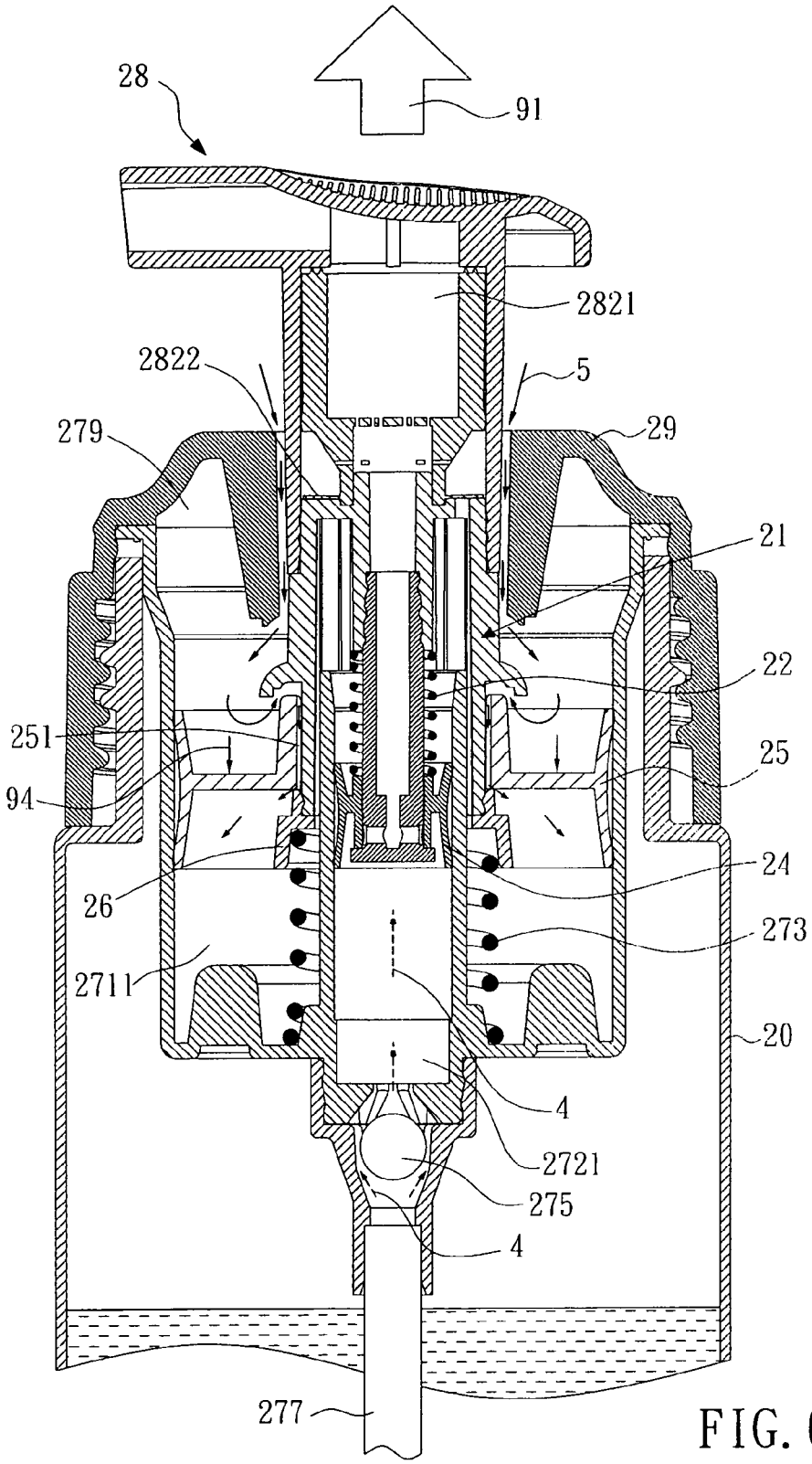
FIG. 6B is a schematic view of the return path of a foam producing apparatus according to the present invention.

Referring to FIG. 6B for the schematic view of the return path of a foam producing apparatus according to the present invention, the foam will be produced if a user presses the fluid/gas mixing nozzle 28 all the way down to the bottom. The resilience of the second resilient member 273 will push the second piston 25 and the sleeve 21 to move upward, after the user releases the fluid/gas mixing nozzle 28. This stage during the upward movement also includes two processes, which are a gas incoming process and a liquid incoming process. For the gas incoming process, the gas in the gas space 2711 is discharged in the previous compressing process, and thus the pressure in the gas space 2711 will be a vacuum state. Since the pressure in the gas space 2711 is small and the pressure of the gas in the external space 279 between the lid 29 and the second piston 25 is the atmospheric pressure, therefore the gas in the external space 279 will produce a pushing force to push the second piston 25 to move downward, so that the second piston 25 presses against the second circular blocking member 26 so as to make the partition space 251 communicate with the external space 279.

The pressure of the gas in the gas space 2711 is smaller than that in the external space 279 during upward movement, and thus the gas in the external space 279 will be sucked into the gas space 2711 in the direction indicated by a solid line in FIG. 6B. After the second resilient member 273 recover to its initial state, the gas space 2711 is filled up with gas again and gets ready for the next compressing process. Meanwhile, during the upward movement, the valve membrane 2822 in the fluid/gas mixing nozzle 28 becomes a one-way check valve to prevent the gas 5 entering from the opening of the nozzle 281 and also prevent the liquid in the fluid mixing space 2821 from flowing back into the gas space 2711, which will affect the compressing effect.

As to the liquid incoming process, the liquid in the liquid space 2721 has been consumed in previous compression. During the returning process, the liquid space 2721 is in a vacuum state, which means that the first piston 24 is no longer exerted by the liquid inside the liquid space, so that the first piston 24 will resume its original position under the action of the restoring force of the first resilient member 22. The liquid space 2721 will be in a vacuum state to generate a sucking force to draw the liquid 4 in the can 20 from the sucking pipe 277 to the liquid space 2721 as indicated by the dotted line in the figure. After the second resilient member 273 and the first resilient member 22 resumes its original uncompressed state, the liquid space 2721 will be filled up with liquid for the next compressing process.

In summation to the description above, the assembly of the present invention has a fluid drawing capability and produces thick foams for the users and thus satisfying the requirements of the industry and enhancing the competitiveness of the industry. The present invention definitely complies with the patent application requirements, and thus is submitted to the Patent and Trademark Office for review and granting of the commensurate patent rights.

What is claimed is:

1. A piston device, comprising:

a sleeve, having a first open end, a first closed end, and one hole, wherein said one hole is disposed around the periphery of said first closed end thereof;

a casing pipe, having a second open end, a second closed end, and one through hole arranged on a lateral side thereof proximate to said second closed end, wherein said casing pipe being sheathed and connected to the sleeve by a manner that said second open end of the casing pipe is faced toward the first closed end of the sleeve;

a first piston, being arranged to ensheathe the casing pipe therethrough at proximate the second closed end of the casing pipe for selectively covering and exposing the though hole by a reciprocate movement;

a resilient member, being installed inside the sleeve and positioned between the first closed end of the sleeve and the first piston while ensheathing the casing pipe therethrough;

a second piston, being arranged to ensheathe the sleeve at proximate the first open end of the sleeve; and a hollow piping, having a third open end, a fourth open end, and a groove on said fourth open end, wherein said third open end is interconnected to the first closed end of the sleeve, said fourth end is disposed inside the sleeve, said groove is accommodating the second open end of the casing pipe, and said resilient member is pressing against said third open end and said first piston.

2. The piston device of claim 1, wherein the sidewall of the sleeve further comprises a first circular blocking member, and the first open end of the sleeve includes a second circular blocking member so that the second piston can move back and forth between the first circular blocking member and the second circular blocking member.

3. The piston device of claim 2, wherein the second piston includes a plurality of protruding ribs disposed on the wall corresponding to the sidewall of the sleeve for forming a plurality of partition spaces between the second piston and the sleeve.

4. A fluid/gas drawing apparatus, comprising:

a sleeve, having a first open end, a first closed and, and one hole, wherein said one hole is disposed around the periphery of said first closed end thereof;

a casing pipe, having a second open end, a second closed end, and one though hole arranged on a lateral side thereof proximate to said second closed end, wherein said casing pipe being sheathed and connected to the sleeve by a manner that said second open end of the casing pipe is faced toward the first closed end of the sleeve;

a first piston, being arranged to ensheathe the casing pipe therethrough at proximate the second closed end of the casing pipe for selectively covering and exposing the though hole by a reciprocate movement;

a resilient member, being installed inside the sleeve and positioned between the first closed end of the sleeve and the first piston while ensheathing the casing pipe therethrough;

a second piston, being sheathed along proximate the first open end of the sleeve;

a casing, including a first space and a second space, and the first space maintaining airtight with the first piston while the second space maintaining airtight with the second piston; and a second resilient member, installed in the casing wherein one end of the second resilient member presses against the second piston while the other end of the second resilient member presses against the bottom of the casing.

5. The fluid/gas drawing apparatus of claim 4, wherein the casing further comprises:

an external pipe for accommodating the second piston, and the internal wall of the external pipe is maintained airtight with the second piston; and an internal pipe, disposed inside the external pipe, interconnecting to the closed end of the external pipe though its open end, and the internal wall of the internal pipe being maintained airtight with the first piston, and the diameter of the internal pipe being smaller than the diameter of the sleeve;

wherein the space formed between the external pipe and the internal pipe is the second space, while the space inside the internal pipe is the first space.

6. The fluid/gas drawing apparatus of claim 5, wherein the second resilient member is arranged around the internal pipe.

7. The fluid/gas drawing apparatus of claim 5 further comprising a check valve, disposed at an end location that the internal pipe interconnects to the external pipe, which includes:

at least one blocking member, disposed on the internal wall of the internal pipe;

a hollow flared member, disposed at the end location that the internal pipe interconnects to the external pipe; and a sphere, disposed between at least one blocking member and the hollow flared member, whose diameter is in the range between the maximum and minimum diameters of the hollow flared member.

8. The fluid/gas drawing apparatus of claim 4, further comprising a hollow piping, having a third open end, a fourth open end, and a groove on said fourth open end, wherein said third open end is coupled to the first closed end of the sleeve, said forth open end is disposed inside the sleeve, and said groove is accommodating the second open end of the casing pipe.

9. The fluid/gas drawing apparatus of claim 8, wherein one end of the first resilient member, disposed in the sleeve, presses against the wall around the third open end of the hollow piping while the other end presses the first piston.

10. The fluid/gas drawing apparatus of claim 4, wherein sidewall of the sleeve further comprises a first circular blocking member disposed thereon, and the open end of the sleeve includes the second circular blocking member.

11. The fluid/gas drawing apparatus of claim 10, wherein the second piston further comprises a plurality of protruding ribs disposed on the wall surface thereof corresponding to the sidewall of the sleeve for forming a plurality of partition spaces between the second piston and the sleeve.

12. A foam producing apparatus, comprising:

a sleeve, having a first open end, a first closed end, and one hole, wherein said one hole is disposed around the periphery of said first closed end thereof;

a casing pipe, having a second open end, a second closed end, and one through hole arranged on a lateral side thereof proximate to said second closed end, wherein said casing pipe being sheathed and connected to the sleeve by a manner that said second open end of the casing pipe is faced toward the first closed end of the sleeve;

a first piston, being arranged to ensheathe the casing pipe therethrough at proximate the second closed end of the casing pipe for selectively covering and exposing the though hole by a reciprocate movement;

a resilient member, being installed inside the sleeve and positioned between the first closed end of the sleeve and the first piston while ensheathing the casing pipe therethrough;

a second piston, being sheathed along proximate the first open end of the sleeve;

a casing, including a first space and a second space, and the first space maintaining airtight with the first piston while the second space maintaining airtight with the second piston;

a second resilient member, installed in the casing wherein one end of the second resilient member presses against the second piston while the other end of the second resilient member presses against the bottom of the casing; and a fluid/gas mixing nozzle, coupled and interconnected to the sleeve.

13. The foam producing apparatus of claim 12, wherein the casing further comprises:

an external pipe for accommodating the second piston, and the internal wall of the external pipe is maintained airtight with the second piston; and an internal pipe, disposed inside the external pipe, interconnecting to the closed end of the external pipe though its open end, and the internal wall of the internal pipe being maintained airtight with the first piston, and the diameter of the internal pipe being smaller than the diameter of the sleeve;

wherein the space formed between the external pipe and the internal pipe is the second space, while the space inside the internal pipe is the first space.

14. The foam producing apparatus of claim 13, wherein the second resilient member is arranged around the internal pipe.

15. The foam producing apparatus of claim 14 further comprising a check valve, disposed at an end location that the internal pipe interconnects to the external pipe, which includes:

at least one blocking member, disposed on the internal wall of the internal pipe;

a hollow flared member, disposed at the end location that the internal pipe interconnects to the external pipe; and a sphere, disposed between at least one blocking member and the hollow flared member, whose diameter is in the range between the maximum and minimum diameters of the hollow flared member.

16. The foam producing apparatus of claim 12, further comprising a hollow piping, having a third open end, a fourth open end, and a groove on said fourth open end, wherein said third open end is coupled to the first closed end of the sleeve, said forth open end is disposed inside the sleeve, and said groove is accommodating the second open end of the casing.

17. The foam producing apparatus of claim 12, wherein one end of the first resilient member, disposed in the sleeve, presses against the wall around the third open end of the hollow piping while the other end presses the first piston.

18. The foam producing apparatus of claim 12, wherein sidewall of the sleeve further comprises a first circular blocking member disposed thereon, and the open end of the sleeve includes the second circular blocking member.

19. The foam producing apparatus of claim 12, wherein the second piston further comprises a plurality of protruding ribs disposed on the wall surface thereof corresponding to the sidewall of the sleeve for forming a plurality of partition spaces between the second piston and the sleeve.

* * * * *